US007967482B2

(12) United States Patent
Horng et al.

(10) Patent No.: US 7,967,482 B2
(45) Date of Patent: Jun. 28, 2011

(54) LAMP

(75) Inventors: Alex Horng, Kaohsiung (TW); Miyahara Masaharu, Kaohsiung (TW); Zhung Zhi-Hao, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 238 days.

(21) Appl. No.: 12/247,590

(22) Filed: Oct. 8, 2008

(65) Prior Publication Data

US 2010/0061098 A1 Mar. 11, 2010

(30) Foreign Application Priority Data

Sep. 9, 2008 (TW) ..... 97134609 A

(51) Int. Cl.
*F21V 29/02* (2006.01)

(52) U.S. Cl. ..... 362/373; 362/294

(58) Field of Classification Search ..... 362/294, 362/373

See application file for complete search history.

(56) References Cited

U.S. PATENT DOCUMENTS

| | | | | |
|---|---|---|---|---|
| 7,144,135 | B2 | 12/2006 | Martin et al. | |
| 7,244,058 | B2 | 7/2007 | DiPenti et al. | |
| 2002/0122309 | A1* | 9/2002 | Abdelhafez et al. | 362/294 |
| 2009/0046473 | A1* | 2/2009 | Tsai et al. | 362/373 |

* cited by examiner

*Primary Examiner* — Stephen F Husar
*Assistant Examiner* — James W Cranson
(74) *Attorney, Agent, or Firm* — Muncy, Geissler, Olds & Lowe, PLLC

(57) ABSTRACT

A lamp comprises a housing, a heat dissipating unit, a light emitting member and a screen. The housing includes a lens and a base on two ends thereof, with an outlet section and an inlet section being formed on the wall of the housing. The heat dissipating unit is mounted inside the housing. The light emitting member is coupled to the heat dissipating unit and electrically connects to the base of the housing. The screen is in the form of a mesh that has a plurality of tiny holes and covers the inlet section of the housing. Consequently, by use of the screen, the lamp can meet standards for safety, gas flow impedance is reduced to enhance dissipating heat dissipating effect of the heat dissipating unit and insects are prevented from entering the housing.

15 Claims, 7 Drawing Sheets

LAMP

BACKGROUND OF THE INVENTION

1. Field of the Invention

The present invention relates to lighting, more particularly, to a lamp that can be fixed to a position and electrically connect to a power supply to illuminate.

2. Description of the Related Art

Referring to FIG. 1, a conventional lamp 9 includes a first shell 91 having a plurality of inlets 911 and a base 912, a second shell 92 having a plurality of outlets 921 and a lens 922, a heat dissipating unit 93 and a light emitting member 94. The inlets 911 are annularly arranged on a wall of the first shell 91 and around the base 912, with a rib 913 being between any adjacent two inlets 911. And the outlets 921 are annularly arranged on a wall of the second shell 92 and around the lens 922, with a rib 923 being between any adjacent two outlets 921. Besides, the first shell 91 and the second shell 92 are combined to jointly form a hollow housing. The heat dissipating unit 93 and the light emitting member 94 coupled to each other are fixed inside the hollow housing, with a light emitter of the light emitting member 94 facing the lens 922.

In use, the lamp 9 is generally coupled to a lamp holder (not illustrated) set on a wall, ceiling or table, so as to electrically connect to a power supply through the base 912 for the light emitting member 94 to emit light penetrating the lens 922 for illuminating. Furthermore, heat generated by the light emitting member 94 can be transmitted to the heat dissipating unit 93 and then be further transmitted to outer space of the hollow housing through the outlets 921 by air flows induced by the heat dissipating unit 93 through the inlets 911. Therefore, life of the light emitting member 94 is extended.

In general, for safety, sizes of the inlets 911 of the first shell 91 and the outlets 921 of the second shell 92 are limited to prevent fingers of a user from getting into the conventional lamp 9 through the inlets 911 or the outlets 921. For example, in UL Standards for Safety, diameters of the inlets 911 of the first shell 91 and the outlets 921 of the second shell 92 are restricted not more than 2 mm. However, during the heat dissipating unit 93 generating the air flows, limitations of size of the inlets 911 and the outlets 921 and gas flow impedance caused by each rib 913 between the inlets 911 of the first shell 91 result in reduction of amount of air inputs. Hence, heat dissipating efficiency of the heat dissipating unit 93 is low. Moreover, while the heat dissipating unit 93 guides the air flows to the outer space, each rib 923 between the outlets 921 of the second shell 92 also causes gas flow impedance, so that the air flows with heat from the light emitting member 94 can't flow smoothly to outer spaces of the housing through the outlets 921. Hence, heat dissipating efficiency of the heat dissipating unit 93 is further lowered. As above description, the conventional lamp 9 has lowered heat dissipating efficiency and life of the light emitting member 94 is not extended effectively. Besides, insects can get into the lamp 9 through the inlets 911 and the outlets 921 of the lamp 9.

SUMMARY OF THE INVENTION

It is therefore the primary objective of this invention to provide a lamp that overcomes the problems of the prior art described above to enhance heat dissipating efficiency.

The secondary objective of this invention is to provide the lamp that can prevent insects from entering the lamp.

The present invention solves the problems in the field of lamp by providing, in a preferred form, a lamp includes a housing, a heat dissipating unit, a light emitting member and a screen. The housing includes a lens and a base on two ends thereof, with an outlet section and an inlet section being formed on the wall of the housing. The heat dissipating unit is mounted inside the housing. The light emitting member is coupled to the heat dissipating unit and electrically connects to the base of the housing. The screen is in the form of a mesh that has a plurality of tiny holes and covers the inlet section of the housing. Accordingly, by use of the screen, the lamp can meet standards for safety, gas flow impedance is reduced to enhance dissipating heat dissipating effect of the heat dissipating unit and insects are prevented from entering the housing.

In an example, each of the inlet section and the outlet section of the housing is covered with a screen. Accordingly, gas flow impedance can be reduced at both the inlet section and the outlet section of the housing, and entry into the housing of the insects is further prevented.

In an example, the screen is a meshed cover or consists of a plurality of meshed covering plates. Accordingly, easy combination between the screen and the housing is provided.

In an example, the screen is a netting member made of threads woven across each other. Accordingly, gas flow impedance can be reduced effectively due to the netting member.

In an example, a distance between centers of any two adjacent tiny holes is smaller than or equal to 2 mm. Accordingly, the lamp can meet standards for safety.

Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
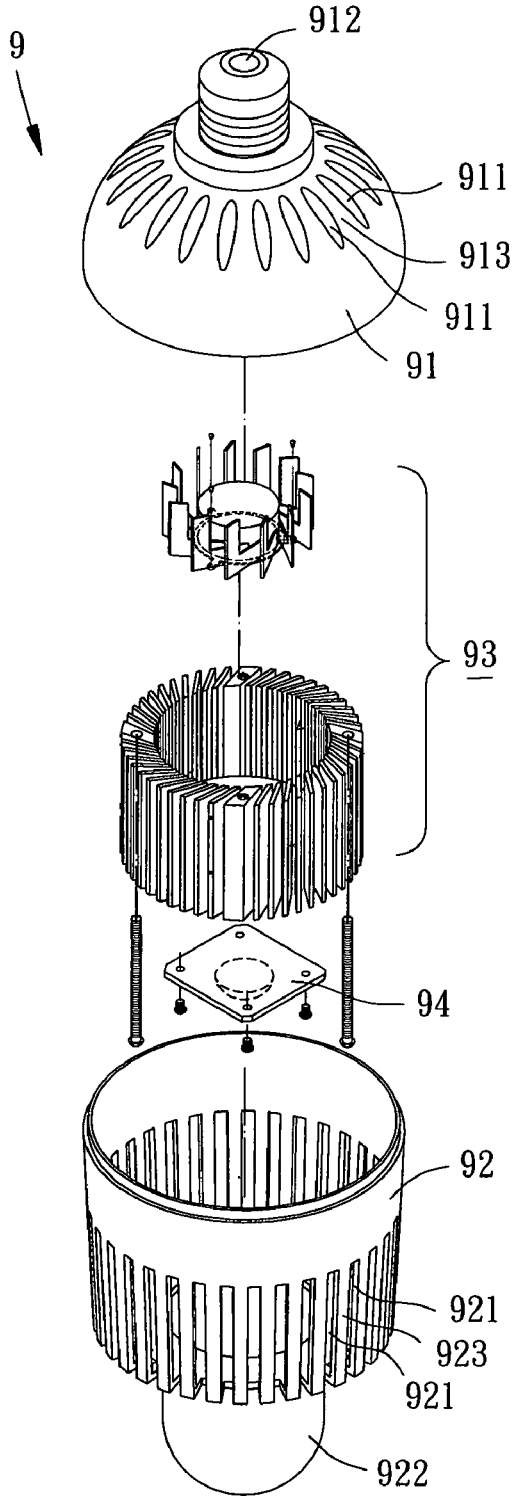
FIG. 1 PRIOR ART
FIG. 1 is an exploded perspective view illustrating a conventional lamp.

In the various figures of the drawings, the same numerals designate the same or similar parts. Furthermore, when the terms "first", "second", "portion", "section", "annular" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 2:
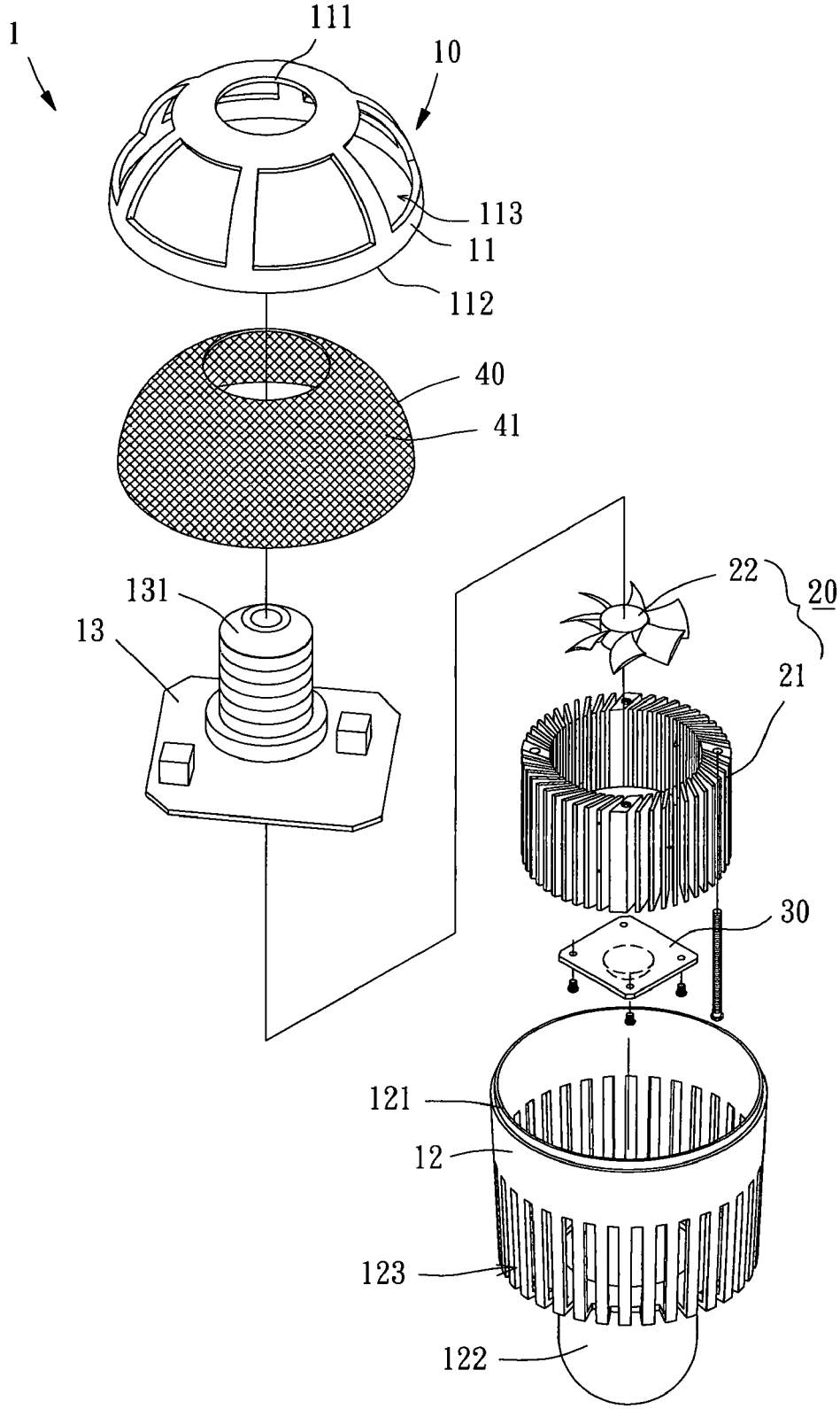
FIG. 2 is an exploded perspective view illustrating a lamp in accordance with a first embodiment of the present invention.
Figure 3:
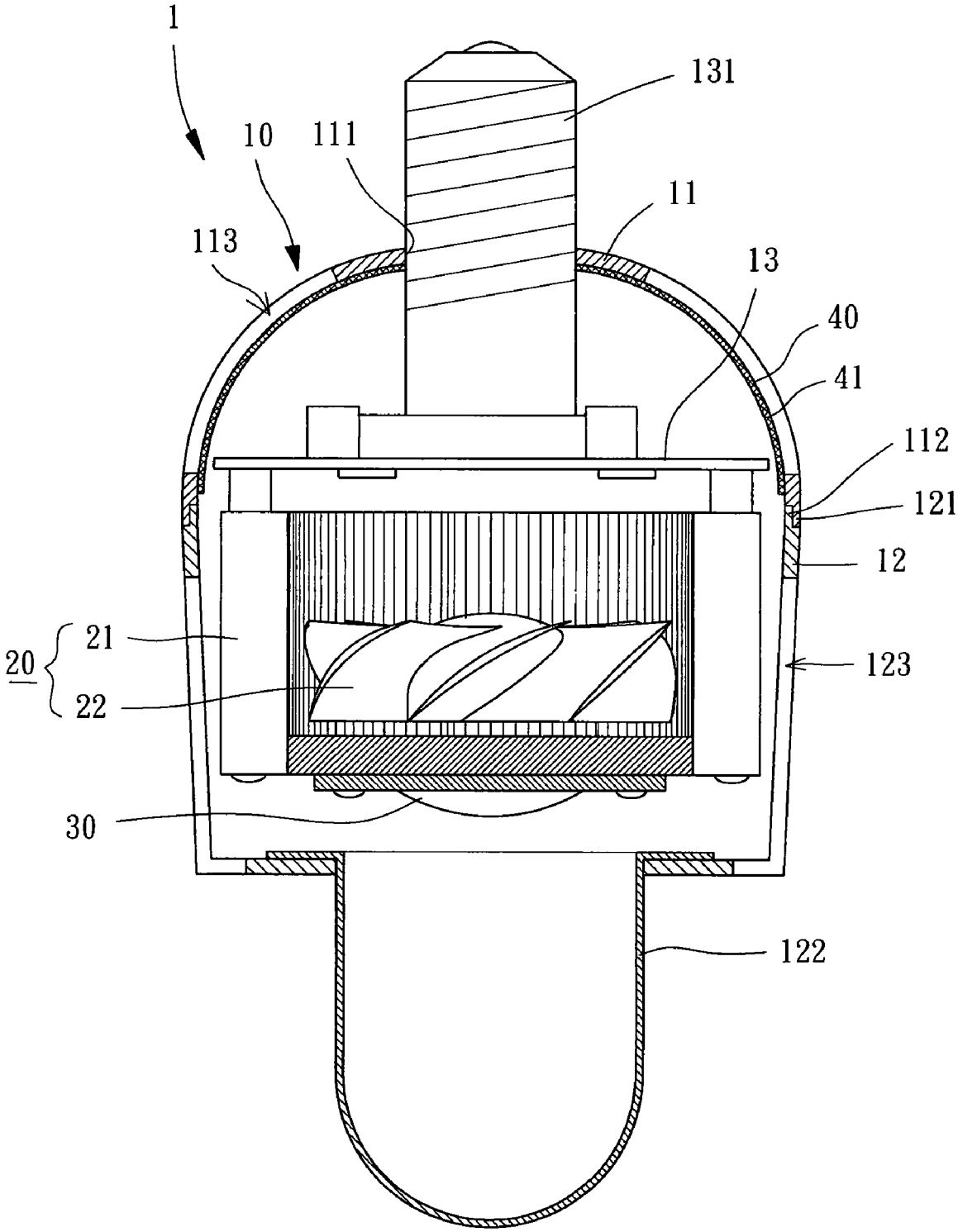
FIG. 3 is a cross sectional view illustrating the lamp in accordance with the first embodiment of the present invention.

A lamp 1 of a first embodiment according to the preferred teachings of the present invention is shown in FIGS. 2 and 3 of the drawings. According to the first embodiment form shown, the lamp 1 includes a housing 10, a heat dissipating unit 20, a light emitting member 30 and a screen 40.

The housing 10 is preferred an integrally made hollow housing or a housing consisting of a plurality of pieces, which is provided for receiving some related components. In the first embodiment, the housing 10 includes a first shell 11 and a second shell 12. The first shell 11 has a hole 111 at one end thereof while the other end of the first shell 11 forms a first engaging portion 112. An inlet section 113 is formed on the wall of the first shell 11, preferably consisting of plural slots annularly arranged in the wall of the first shell 11. One end of the second shell 12 forms a second engaging portion 121 while the other end of the second shell 12 has a lens 122. An outlet section 123 is formed on the wall of the second shell 12, preferably consisting of plural slots annularly arranged in the wall of the second shell 12. The first engaging portion 112 of the first shell 11 is engaged with the second engaging portion 121 of the second shell 12 to form the whole housing 10. Sizes of the slots of the inlet section 113 and the outlet section 123 are designed to be large enough for air flows outside the housing 10 to smoothly pass through while gas flow impedance is seldom caused. And amounts of ribs between two adjacent slots of the inlet section 113 and the outlet section 123 are both reduced.

There is a controlling member 13 mounted inside the housing 10 and having a base 131 extending out of the housing 10 through the hole 111.

The heat dissipating unit 20 is mounted inside the housing and includes a heat sink 21 made of thermally conductive materials and a fan 22. The fan 22 is fixed inside a chamber of the heat sink 21.

The light emitting member 30 is preferably selected from a light-emitting diode (LED), a bulb or any other components that can emit light after an electric current passes. The light emitting member 30 is fixed to the heat sink 21 of the heat dissipating unit 20 and aligned with the fan 22 to face the lens 122 of the housing 10, with the light emitting member 30 electrically connecting to the base 131 of the controlling member 13.

The screen 40 is preferably selected from a metal netting member made of metal threads woven across each other or a non-metal netting member with the same structure in the form of a mesh that has a plurality of tiny holes 41. Furthermore, the screen 40 is a meshed cover through which the base 131 extends and attached to a periphery of the housing 10 to fully covers the inlet section 113 of the housing 10. The meshed cover is preferably attached to an inner periphery of the housing 10 as shown in FIG. 3, or alternatively attached to an outer periphery of the housing 10 (not illustrated) if necessary, to cover the inlet section 113. The screen 40 is fixed to the housing 10 by engaging, adhesive or other means. Even if slots of the inlet section 113 of the housing 10 are too large to meet the standards (a diameter not more than 2 mm in UL Standards for Safety), the lamp 1 of the present invention still can meet the UL Standards by the screen 40 covering the inlet section 113 of the housing 10 and having tiny holes 41 with diameters which meet limitations of the standards. For instance, a distance between centers of any two adjacent tiny holes 41 is smaller than or equal to 2 mm, so that the lamp 1 of the present invention can meet UL Standards for Safety. Besides, the screen 40 is constructed from threads or wires woven across each other, such that gas flow impedance is seldom caused. Therefore, air flows can smoothly pass through the inlet section 113 or the outlet section 123 of the housing 10 to assure of heat dissipating effect of the heat dissipating unit 20.

In use, the lamp 1 of the present invention is coupled to a lamp holder (not illustrated) on a wall, ceiling or table with the base 131 electrically connecting to a power supply through the lamp holder, so that the light emitting member 30 emits light penetrating the lens 122 for illuminating. Furthermore, heat generated by the light emitting member 30 can be transmitted to the heat sink 21 and then be transferred to outside the housing 10 through the outlet section 123 by air flows formed by the fan 22 which forms air intake through the inlet section 113. Therefore, heat dissipating effect is provided to extend life of the light emitting member 30.

Figure 4:
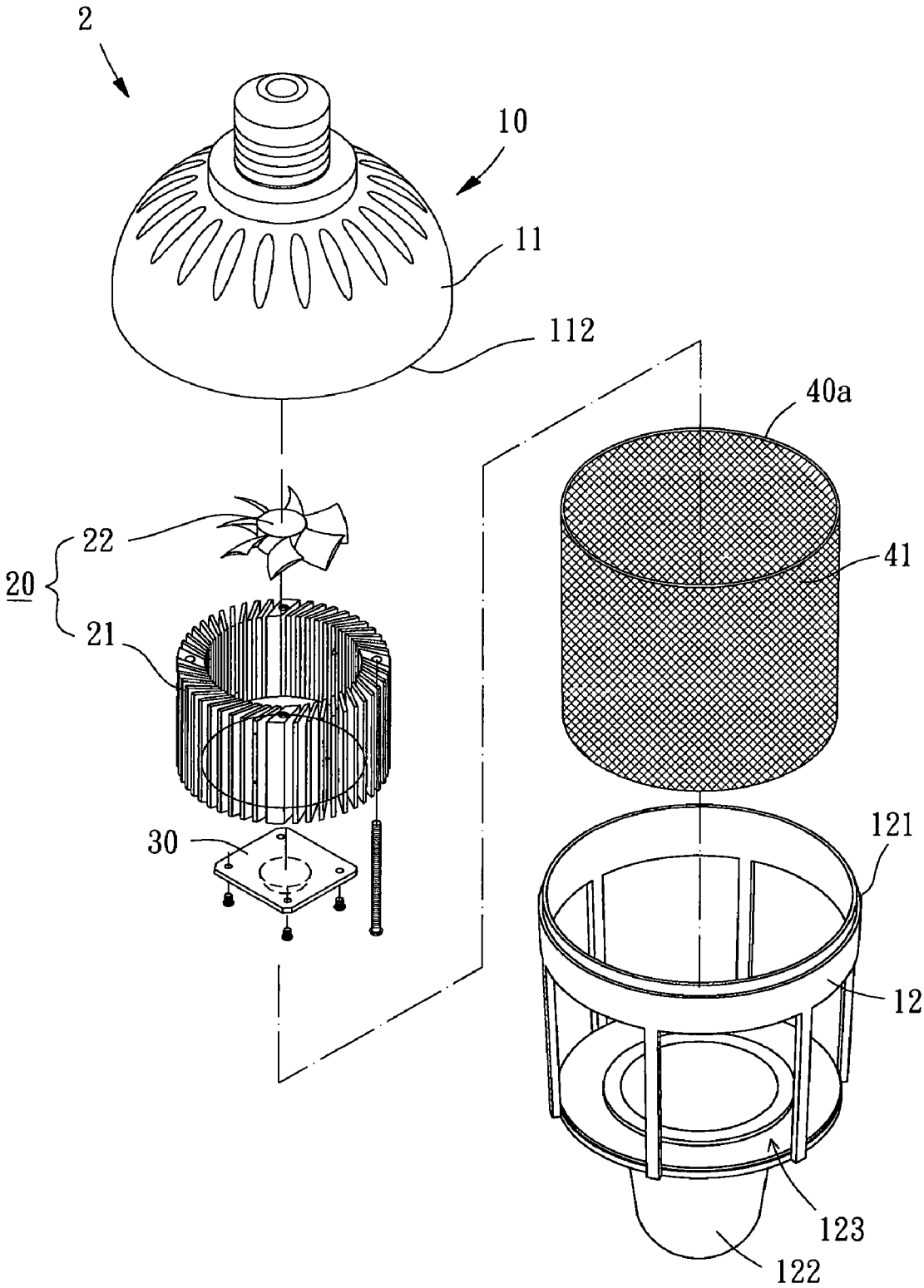
FIG. 4 is an exploded perspective view illustrating a lamp in accordance with a second embodiment of the present invention.
Figure 5:
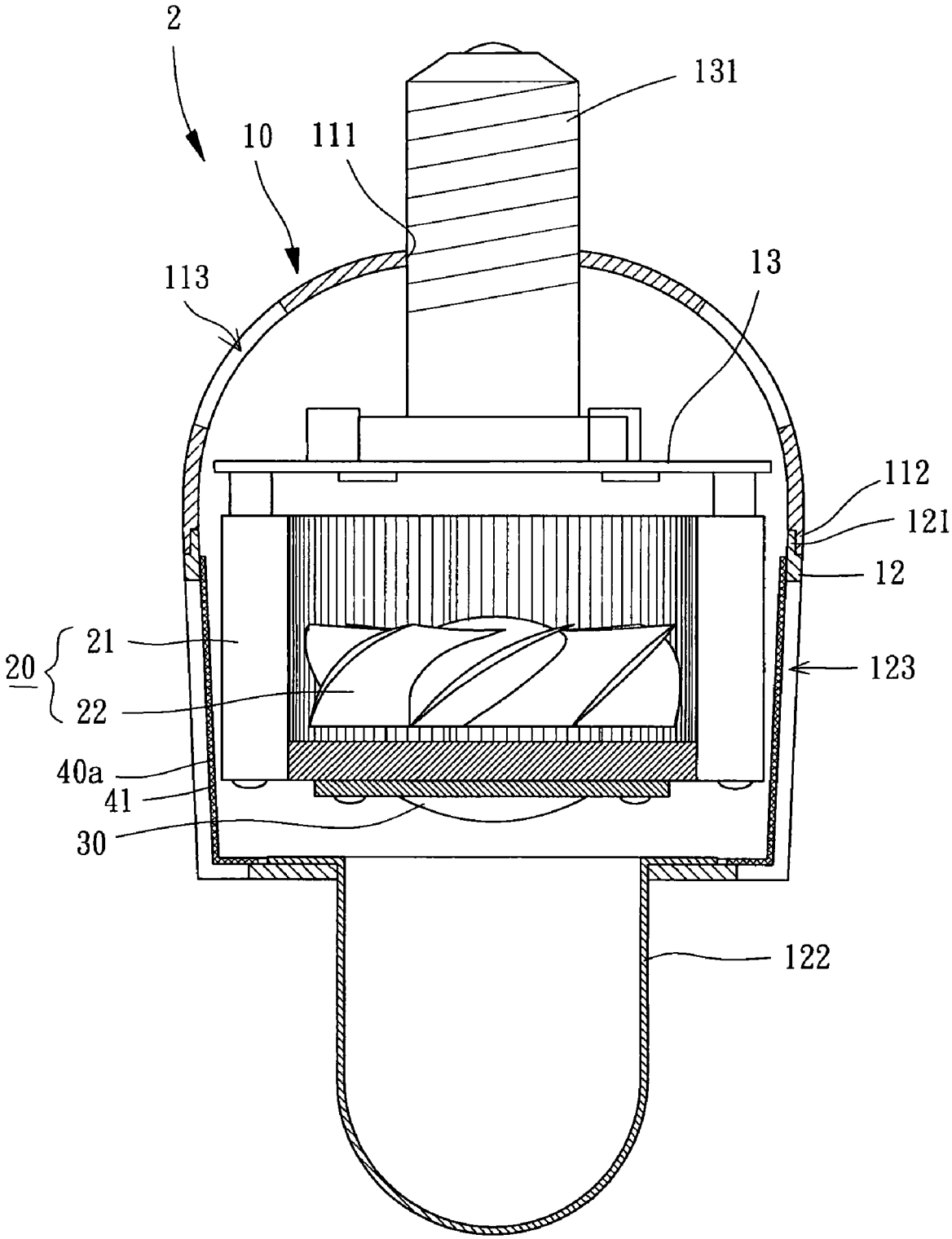
FIG. 5 is a cross sectional view illustrating the lamp in accordance with the second embodiment of the present invention.

Please refer to FIGS. 4 and 5, a lamp 2 of a second embodiment according to the preferred teachings of the present invention is shown. The lamp 2 also includes a housing 10, a heat dissipating unit 20, a light emitting member 30 and a screen 40*a*, wherein descriptions of the housing 10, the heat dissipating unit 20 and the light emitting member 30 are omitted. The screen 40*a* covers the outlet section 123 of the housing 10 and is a meshed cover surrounding the heat dissipating unit 20. The meshed cover is preferably attached to an inner periphery of the housing 10 as shown in FIG. 5, or alternatively attached to an outer periphery of the housing 10 (not illustrated) if necessary, to cover the outlet section 123.

Figure 6:
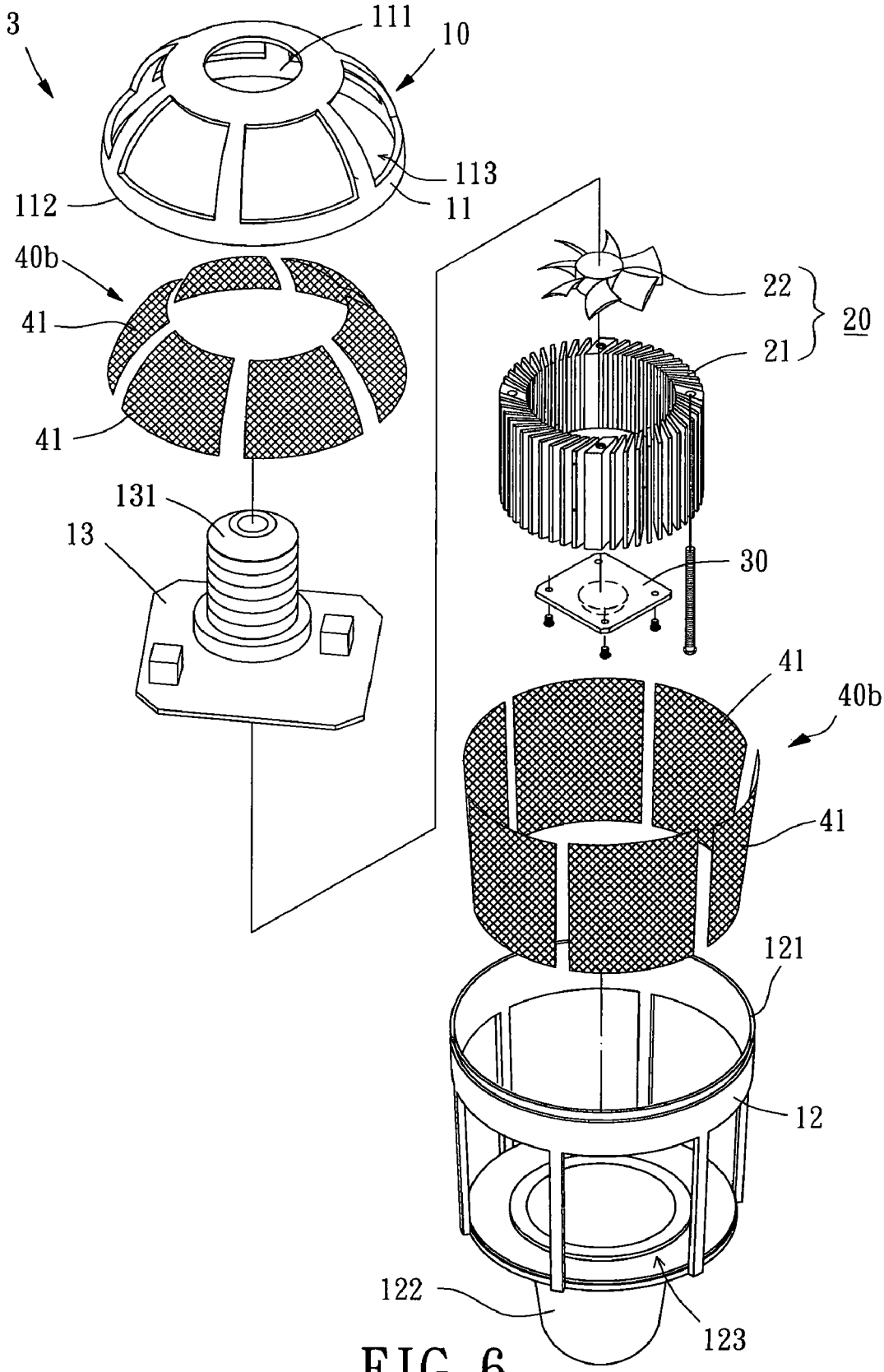
FIG. 6 is an exploded perspective view illustrating a lamp in accordance with a third embodiment of the present invention.
Figure 7:
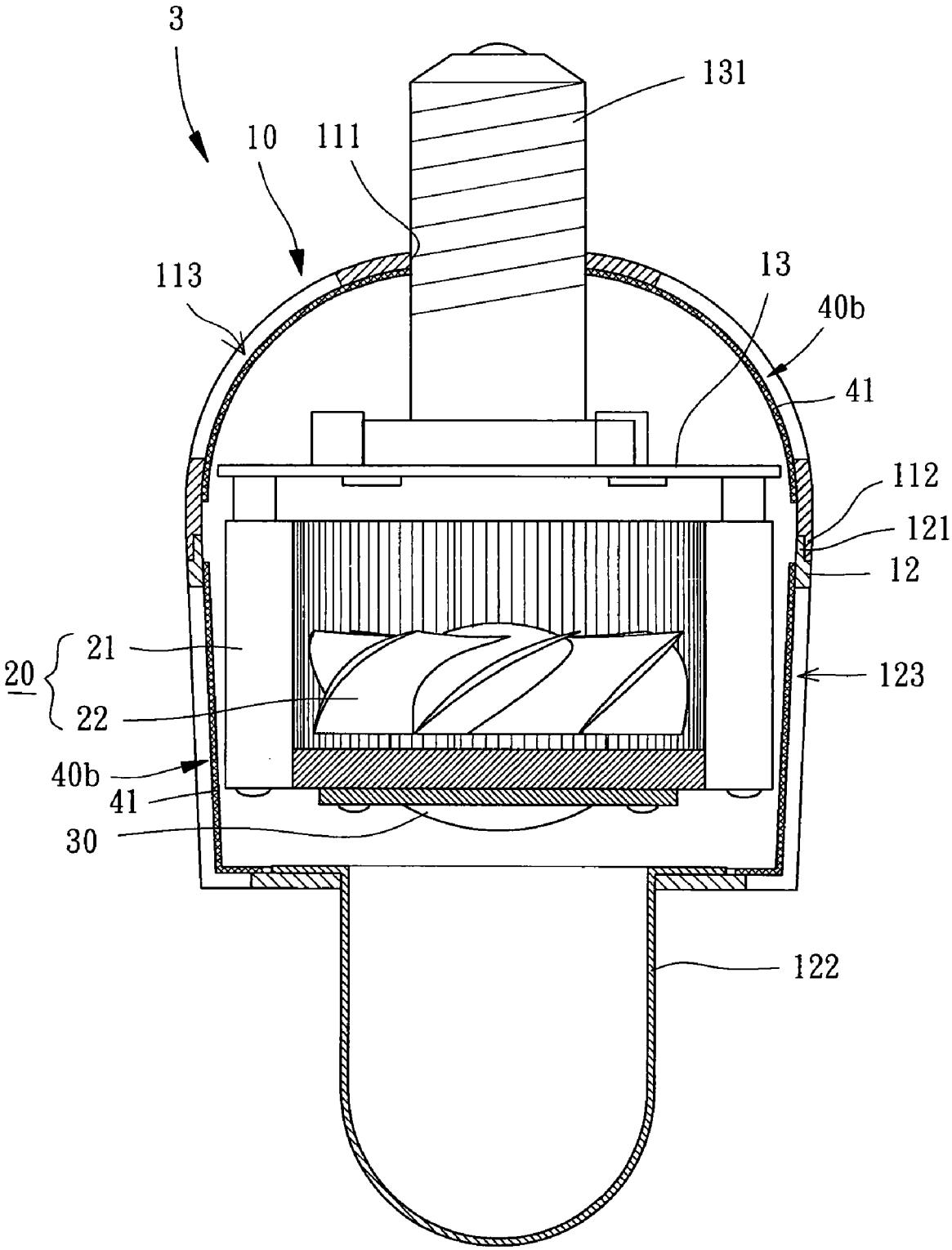
FIG. 7 is a cross sectional view illustrating the lamp in accordance with the third embodiment of the present invention.

Please refer to FIGS. 6 and 7, a lamp 3 of a third embodiment according to the preferred teachings of the present invention is shown. The lamp 3 also includes a housing 10, a heat dissipating unit 20, a light emitting member 30 and two screens 40*b*, wherein descriptions of the housing 10, the heat dissipating unit 20 and the light emitting member 30 are omitted. The two screens 40*b* covers the inlet section 113 and the outlet section 123 of the housing 10 respectively. The two screens 40*b* both consist of a plurality of meshed covering plates and each meshed covering plate is preferably attached to an inner periphery of the housing 10 as shown in FIG. 7, or alternatively attached to an outer periphery of the housing 10 (not illustrated) if necessary. Besides, the two screens 40*b* can be jointly formed into a single piece to enhance assembling convenience.

As has been discussed above, with the screen 40, 40*a*, 40*b*, sizes of slots of the inlet section 113 or the outlet section 123 of the housing 10 can be enlarged appropriately for air flows smoothly passing through the inlet section 113 or the outlet section 123. Hence, air input or air output is increased to enhance heat dissipating effect of the heat dissipating unit 20. Moreover, in order to meet the standards for safety, sizes of the tiny holes 41 of the screen 40 are limited within dimensions of the standards for safety when sizes of slots of the inlet section 113 or the outlet section 123 of the housing 10 are too large to meet the standards for safety. Because the screen 40, 40*a*, 40*b* made of metal or nonmetal materials are meshed, recirculation and bypass of the air flows are avoided to reduce gas flow impedance. Therefore, heat dissipating effect of the heat dissipating unit 20 is maintained to extend life of the light emitting member 30 effectively.

Further, insects are prevented from entering the housing 10 through the inlet section 113 or the outlet section 123 by use of the screen 40, 40*a*, 40*b* of the present invention, such that damage of some related components inside the housing 10 is avoided and the inside of the housing 10 is kept clean.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a housing including a lens and a base on two ends thereof, with an outlet section and an inlet section being formed on the wall of the housing, wherein the inlet section has plural slots and plural ribs, with each rib sitting between two adjacent slots, with the plural slots occupying at least two times the area than that of the plural ribs;

a heat dissipating unit being mounted inside the housing, with the radial external surfaces of the heat dissipating unit facing the outlet section;

a light emitting member being coupled to the heat dissipating unit and electrically connecting to the base of the housing; and a screen being in the form of a mesh that has a plurality of tiny holes and covering the inlet section of the housing.

2. The lamp as defined in claim 1, wherein the inlet section consists of plural slots annularly arranged in the wall of the housing and the screen is a meshed cover attached to an inner periphery or an outer periphery of the housing.

3. The lamp as defined in claim 1, wherein the inlet section consists of plural slots annularly arranged in the wall of the housing and the screen consist of a plurality of meshed covering plates, with each meshed covering plate covering each slot of the inlet section.

4. The lamp as defined in claim 1, wherein another screen in the form of a mesh that has a plurality of tiny holes covers the outlet section of the housing.

5. The lamp as defined in claim 4, wherein the outlet section consists of plural slots annularly arranged in the wall of the housing and said another screen is a meshed cover forming the tiny holes.

6. The lamp as defined in claim 4, wherein the outlet section consists of plural slots annularly arranged in the wall of the housing and said another screen consist of a plurality of meshed covering plates, with each meshed covering plate covering each slot of the outlet section.

7. The lamp as defined in claim 1, wherein the screen is a netting member made of threads woven across each other.

8. The lamp as defined in claim 1, wherein a distance between centers of any two adjacent tiny holes of the screen is smaller than or equal to 2 mm.

9. A lamp, comprising:

a housing including a lens and a base on two ends thereof, with an outlet section and an inlet section being formed on the wall of the housing, wherein the outlet section has plural slots and plural ribs, with each rib sitting between two adjacent slots, with the plural slots occupying at least two times the area than that of the plural ribs;

a heat dissipating unit being mounted inside the housing, with the radial external surfaces of the heat dissipating unit facing the outlet section;

a light emitting member being coupled to the heat dissipating unit and electrically connecting to the base of the housing; and a screen being in the form of a mesh that has a plurality of tiny holes and covering the outlet section of the housing.

10. The lamp as defined in claim 9, wherein the outlet section consists of plural slots annularly arranged in the wall of the housing and the screen is a meshed cover attached to an inner periphery or an outer periphery of the housing.

11. The lamp as defined in claim 9, wherein the outlet section consists of plural slots annularly arranged in the wall of the housing and the screen consist of a plurality of meshed covering plates, with each meshed covering plate covering each slot of the outlet section.

12. The lamp as defined in claim 9, wherein the screen is a netting member made of threads woven across each other.

13. The lamp as defined in claim 9, wherein a distance between centers of any two adjacent tiny holes of the screen is smaller than or equal to 2 mm.

14. The lamp as defined in claim 9, wherein another screen covers the inlet section of the housing, with said another screen and the screen covering the outlet section being jointly formed into a single piece.

15. The lamp as defined in claim 9, wherein another screen is set on the inlet section, and said another screen is a meshed cover attached to an inner periphery or an outer periphery of the inlet section.

* * * * *